US006666600B1

(12) United States Patent
Shirota et al.

(10) Patent No.: US 6,666,600 B1
(45) Date of Patent: Dec. 23, 2003

(54) PRINTER HAVING DETECTION AND CORRECTION OF TILT USING SKEW CORRECTION

(75) Inventors: Kazue Shirota, Narashino (JP); Keiichiro Takahashi, Narashino (JP)

(73) Assignee: Seiko Precision Inc., Chiba-ken (JP)

( * ) Notice: Subject to any disclaimer, the term of this patent is extended or adjusted under 35 U.S.C. 154(b) by 0 days.

(21) Appl. No.: 10/440,830

(22) Filed: May 19, 2003

(30) Foreign Application Priority Data

May 28, 2002 (JP) ..... 2002-154529

(51) Int. Cl.[7] ..... B41J 11/42; B41J 11/20; B41J 13/26

(52) U.S. Cl. ..... 400/579; 400/55; 400/56; 400/57; 400/58; 400/59; 400/630; 400/631; 400/632; 400/632.1; 400/633.2; 400/23

(58) Field of Search ..... 400/579, 55–59, 400/630–633.2, 23, 636.3; 101/248, 183, 415.1, 136

(56) References Cited

U.S. PATENT DOCUMENTS 5,774,777 A * 6/1998 Ohtsuka et al. ..... 399/384
6,189,991 B1 * 2/2001 Wen et al. ..... 347/13
6,271,869 B1 * 8/2001 Tada et al. ..... 347/116
6,546,863 B2 * 4/2003 Schaum et al. ..... 101/248
6,601,951 B2 * 8/2003 Kuwabara et al. ..... 347/101
6,603,497 B2 * 8/2003 Hevenor et al. ..... 347/217
6,603,953 B2 * 8/2003 Jewell ..... 399/395
6,604,739 B2 * 8/2003 Forch et al. ..... 271/228
2002/0096824 A1 * 7/2002 Forch et al. ..... 271/226
2003/0035593 A1 * 2/2003 Rombola et al. ..... 382/289
2003/0044086 A1 * 3/2003 Jia et al. ..... 382/296

FOREIGN PATENT DOCUMENTS

JP 1-267075 * 10/1989 ..... B41J/13/02
JP 2001-7987 * 6/1999 ..... H04N/1/04

* cited by examiner

*Primary Examiner*—Andrew H. Hirshfeld
*Assistant Examiner*—Wasseem H. Hamdan
(74) *Attorney, Agent, or Firm*—Jordan and Hamburg LLP

(57) ABSTRACT

There is provided an apparatus which can make a correction such that paper will not be fed in a tilted state without a need for any special mechanism. A moving mechanism C1 is driven to move a printing head 41 toward a platen and to urge the printing head against paper, and gap adjusting means C2 is driven using said position as a reference to space the printing head from the platen a predetermined amount, thereby adjusting a gap between the printing head and the platen. The direction and amount of a tilt of the paper are detected based on signals output by paper detecting sensors E when the paper is fed. When said amount of the tilt exceeds a predetermined range, head driving means A and the moving mechanism C1 are driven to sandwich an edge of the paper in the direction of the width thereof between the printing head and the platen, and the sandwiched state is adjusted by the gap adjusting means C2. The paper feed means B is then driven to rotate the paper depending on the tilting direction about the sandwiched portion to correct the amount of the tilt such that it stays within the predetermined range.

4 Claims, 6 Drawing Sheets

CORRECTION OF SKEW OF CUT FROM

PRINTER HAVING DETECTION AND CORRECTION OF TILT USING SKEW CORRECTION

BACKGROUND OF THE INVENTION

Some conventional printers perform a recording operation by feeding recording paper in the direction of the width of the same in a recording section while moving it in a paper feed direction. In particular, when a recording operation is performed on a cut form that is manually fed such as an envelope or cut paper, it is necessary for preferable recording to move the recording paper in a feeding direction such that it is not tilted in the direction of the width thereof. Referring to the prior art, for example, JP-A-1-267075 has disclosed an example in which a plurality of pinch rollers are provided side by side in the direction of the width of paper; means is provided for obtaining a correction amount for a pressure to be applied from each of the pinch rollers to a capstan roller when recording paper is moved in a feeding direction; and a pressure correction controller for controlling the applied pressure based on the correction amount.

For example, according to JP-A-5-155086, a paper feed roller and a separating roller are rotated in a forward direction and an inserter driving roller is rotated in the reverse direction when paper is fed. When the leading edge of the paper is located above a sensor, a control circuit detects that the output of the sensor has been turned on and feeds the paper further by the distance between the sensor and the inserter driving roller plus an overfeed amount. The overfeed amount is set at a great value for thick paper and at a smaller value for thinner paper. In the example disclosed, the inserter driving roller is then rotated in the forward direction to put the paper feed roller and the separating roller in an idle state.

However, in the first example of the prior art, there is a need for special mechanisms, i.e., the means for obtaining correction amounts for respective pressures to be applied by the pinch rollers to the capstan roller and the pressure correction controller for controlling the applied pressures based on the correction amounts, which has resulted in the problem of a cost increase. In the second example of the prior art, when paper is deflected by overfeeding the same, the thickness of the paper and the amount of deflection may not be in an appropriate relationship, and a problem has arisen in such a case in that a tilted state cannot be corrected.

Under such circumstances, the invention provides an apparatus which allows correction to be performed to prevent paper from being fed in a tilted state without a need for any special mechanism.

SUMMARY OF THE INVENTION

A printer according to the invention is characterized in that it has head driving means for moving a printing head along a platen in the direction of the width of paper that is orthogonal to a paper feed direction, paper feed means for feeding paper into a gap between said printing head and said platen, paper detecting sensors for detecting the position of the leading edge of said paper in a plurality of positions in the direction of the width of the paper when said paper is fed, a moving mechanism for moving said printing head toward and away from said platen; and gap adjusting means for driving said moving mechanism in the direction in which said printing head moves toward said platen to urge said printing head against said paper and for spacing said printing head from said platen a predetermined amount with said position serving as a reference, thereby adjusting the gap between said printing head and said platen, and skew correcting means for detecting the direction and amount of a tilt of said paper based on signals output by said paper detecting sensors when said the paper is fed and for driving said head driving means and said moving mechanism such that an edge of said paper in the direction of the width thereof is sandwiched between said printing head and said platen when said amount of the tilt exceeds a predetermined range and driving said paper feed means such that the paper is rotated about the sandwiched portion depending on the direction of the tilt, thereby correcting the amount of the tilt such that it stays in the predetermined range. Since the skew correcting means operates by sandwiching paper using the head driving mechanism for moving the printing head along the platen, the moving means for moving the printing head toward and away from the platen, and the gap adjusting means and by rotating the paper with the paper feed means, a tilted state of paper can be easily corrected without a need for any special mechanism other than those of a printer.

Said skew correcting means preferably controls the driving of said head driving means and said paper feed means such that said sandwiched portion is always said edge of the paper in the direction of the width thereof regardless of said direction of tilt and such that said feeding direction of the paper is switched depending on said direction of the tilt.

Said skew correcting means preferably switches the sandwiched portion between the edge of the paper in the direction of the width thereof and another edge of the same depending on said direction of the tilt and controls the driving of said head driving means and the paper feed unit such that the feeding direction of the paper is always a constant direction regardless of said direction of the tilt.

Said paper detecting sensors are preferably disposed in positions in which they face both edges of said paper in the direction of the width thereof. This maximizes the amount of the tilt of the paper to allow accurate correction of a tilted state.

A mode for carrying out the invention will now be described with reference to the accompanying drawings.

DESCRIPTION OF THE PREFERRED EMBODIMENTS

A printer according to the invention is primarily aimed at recording on a cut form that is manually fed such as an envelope or cut paper as recording paper, and a description will now be made on a configuration of a mechanical section for such a purpose with reference to FIGS. 1 to 3.

Figure 1:
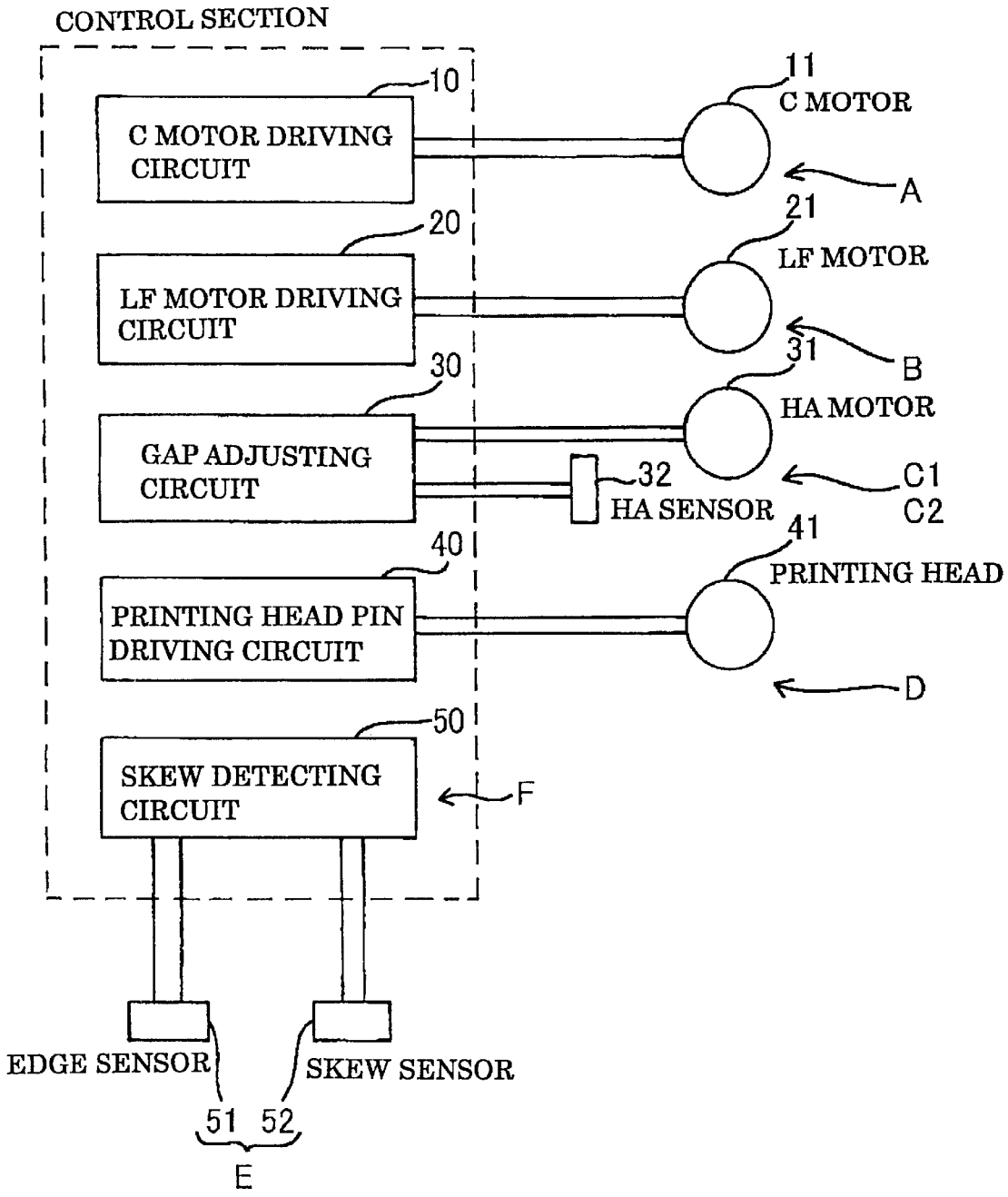
FIG. 1 is a block diagram illustrating a configuration according to the invention.

As shown in FIG. 1, a carriage motor (motor) driving circuit 10, a paper feed motor (LF motor) driving circuit 20, a gap adjusting circuit 30, a printing head pin driving circuit 40, and a skew detecting circuit 50 are provided in a control section of a printer. The carriage motor 11 is driven under the control of the carriage motor driving circuit 10 to configure head driving means A for moving a printing head on a carriage to be described later in the direction of the width of paper. The paper feed motor 21 is driven under the control of the paper feed motor driving circuit 20 to configure paper feed means B for feeding paper to a printing section. The gap adjusting motor 31 is driven under the control of the gap adjusting circuit 30 to configure a moving mechanism C1 for moving the printing head toward and away from a platen and to configure gap adjusting means C2 for adjusting a gap between the printing head and the platen. A printing signal is supplied to a printing head 41 under the printing head pin control circuit 40 to configure printing means D for performing printing on paper. The skew detecting circuit 50 constitutes skew detecting means F that detects the direction and amount of a tile of paper based on signals output by an edge sensor 51 and a skew sensor 52 that constitute paper detection sensors E.

Figure 2:
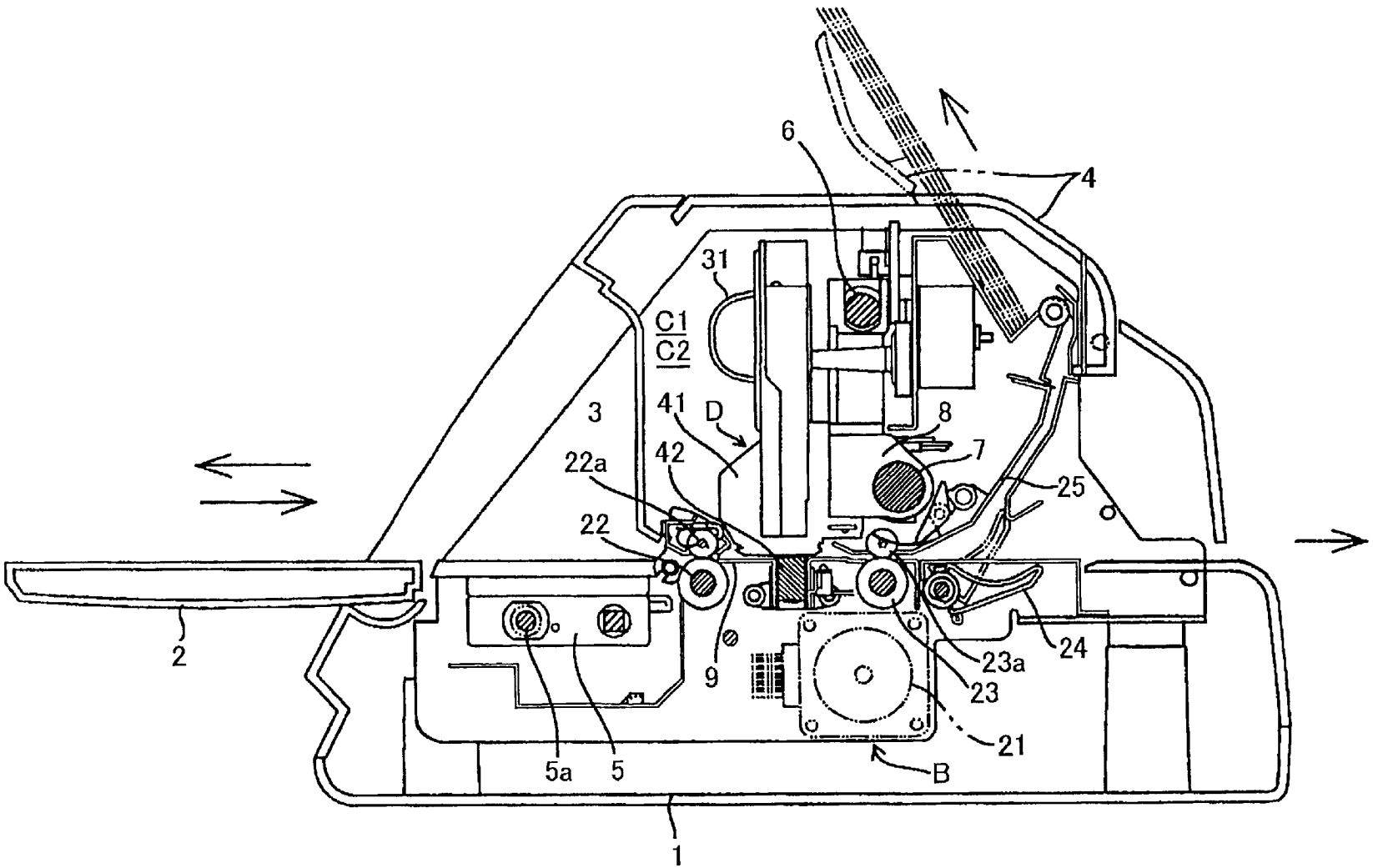
FIG. 2 is a sectional view showing a mode for carrying out the invention.
Figure 3:
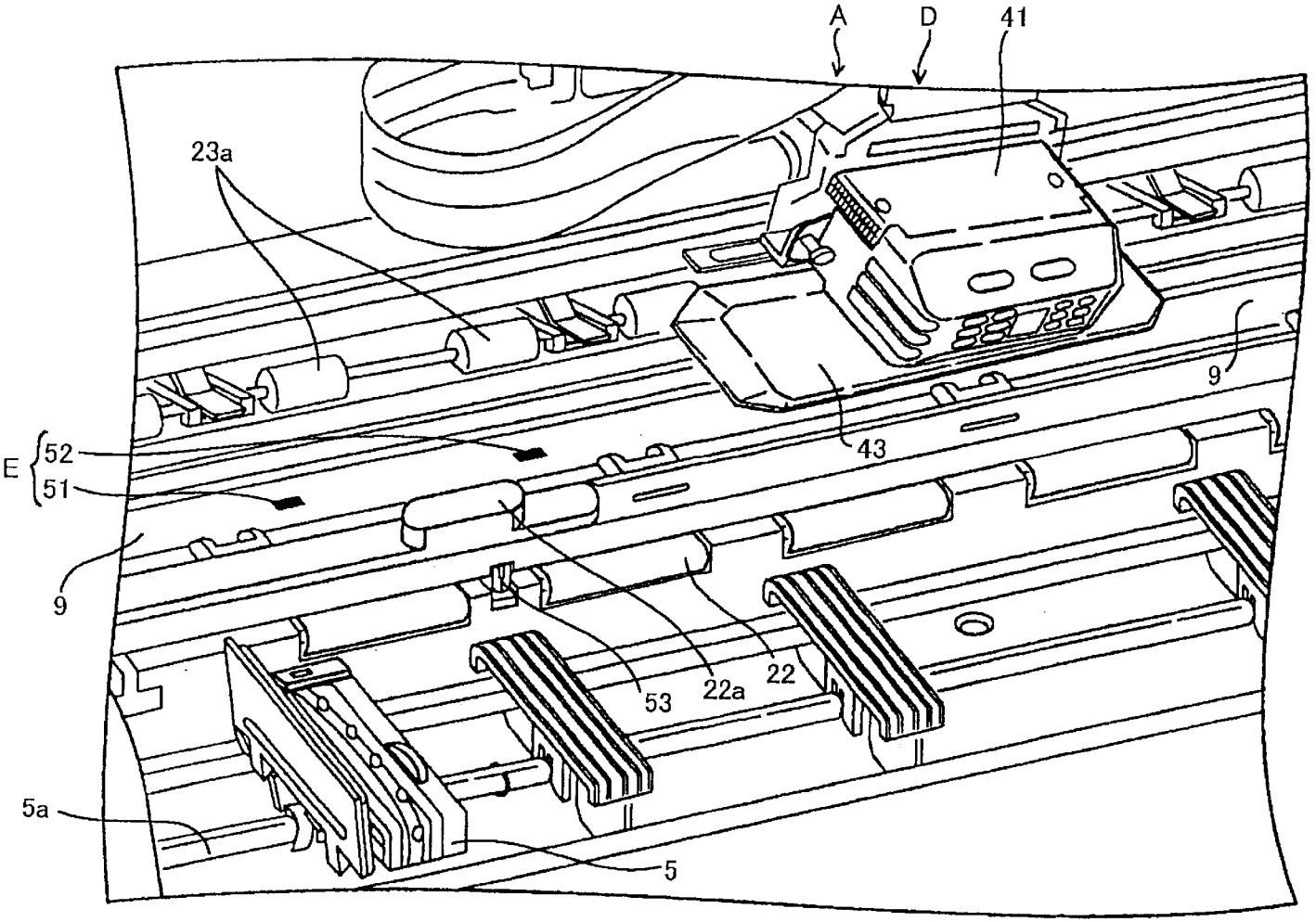
FIG. 3 is an enlarged perspective view of a major part of the same.

FIG. 2 and FIG. 3 show a mechanical section of the printer. An outer case 1 is provided with a front cover 2 that can be opened and closed on a front side (left side) thereof; a partition cover 3 that can be opened and closed is provide inside the front cover 2; and a top cover 4 that can be opened and closed is provided on a top side thereof. Behind a bottom end of the front cover 2 about which the cover is swung, a front tractor 5 is provided such that it can be swung about a shaft 5*a*. Paper is manually supplied from the front side of the printer to be fed into the printing section when the front cover 2 is opened with the front tractor 5 in a horizontal position. The paper is advanced by a forward rotation of the paper feed motor 21 to the printing section where it is printed and, after printing, the paper is advanced as it is by a forward rotation of the paper feed motor 21 to be ejected from a rear side of the printer or an opening provide by opening the top cover 4. Alternatively, the paper feed motor 21 may be rotated in the reverse direction after printing to retract the paper and eject it from the front side of the printer.

A platen 42 is provided in a face-to-face relationship with the printing head 41 at the printing section inside the outer case 1, and an ink ribbon which is not shown is transported in one direction between the printing head 41 and the platen 42. The printing head 41 is carried by a carriage 8 that can be moved under the guidance of upper and lower guide shafts 6 and 7. Both ends of the guide shafts 6 and 7 are supported by both of side plates that are provided in a face-to-face relationship in the vicinity of both sides of the outer case 1; the lower guide shaft 7 penetrates through the carriage 8 to guide the printing head 41 in the direction of the width of paper; and the upper guide shaft 6 guides the carriage 8 while allowing it to move upward and downward. Therefore, the printing head 41 can be moved by the head driving means A in the direction of the width of paper and can be moved by the moving mechanism C1 toward and away from the platen 42.

The paper feed means B for paper manually supplied from the front side of the printer will now be described. A paper guide 9 is provided horizontally such that it extends from the neighborhood of an inner end of the front tractor 5 to a paper ejecting section through the gap between the printing head 41 and the platen 42. Paper feed rollers 22 and 23 are disposed at front and rear ends of the paper guide 9. A turning force of the paper feed motor 21 is transmitted to the paper feed rollers 22 and 23 through a gear train which is not shown to drive each of the paper feed rollers 22 and 23 for cooperative rotation. Driven rollers 22*a* and 23*a* provided on the printing head 41 side of the paper feed path are in elastic contact with the paper feed rollers 22 and 23, and paper is fed by the feed rollers 22 and 23 and the driven rollers 22*a* and 23*a* that are paired respectively. A paper transport path 25 is formed such that it extends backward and upward from the rear end of the paper guide 9 through a switch lever 24 that can be swung. The paper can be ejected backward by swinging the switch lever 24 to a horizontal position and can alternatively be guided onto the top cover 4 and ejected therefrom by swinging the switch lever 24 to a tilted position to open the top cover 4.

A description will now be made on the skew detecting means F for detecting whether manually supplied paper has been fed in a tilted state. As shown in FIG. 3, a paper sensor 53 is disposed at the front end of the paper guide 9. An edge sensor 51 and a skew sensor 52 that are paper detecting sensors E are incorporated in the paper guide 9 behind the paper sensor 53. The edge sensor 51 and the skew sensor 52 are disposed in a plurality of positions which are spaced from each other in the direction of the width of paper; the edge sensor 51 is disposed leftward in the direction in which paper is advanced; and the skew sensor 52 is located on the right side of the edge sensor 51. Signals output by the edge sensor 51 and the skew sensor 52 are supplied to the skew detecting circuit 50 to constitute the skew detecting means F.

When the amount of a tilt detected by the skew detecting means F exceeds a predetermined range, it is corrected by skew correcting means G.

Figure 4:
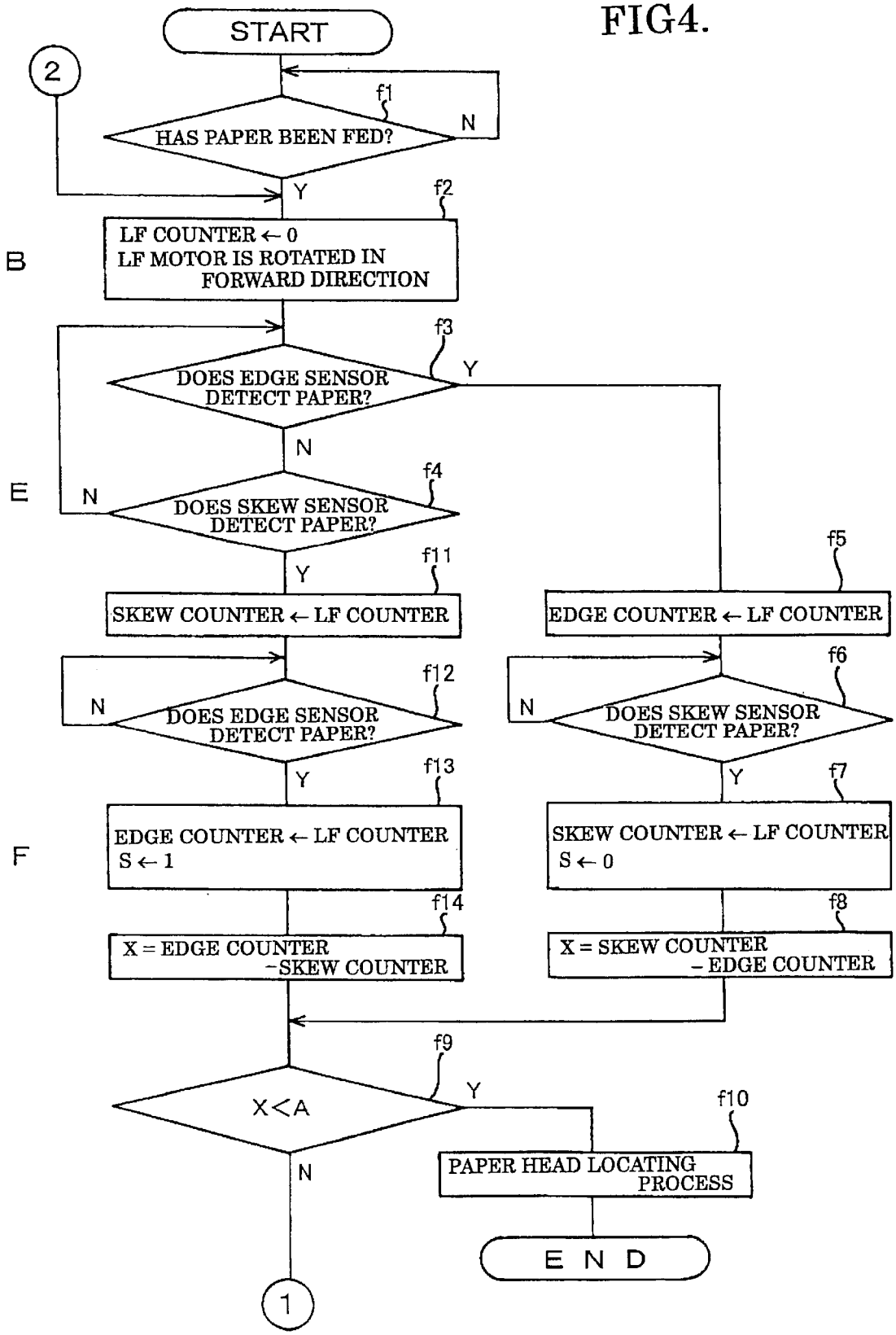
FIG. 4 is a flow chart for explaining an operation of detecting a tilted state of paper.
Figure 5:
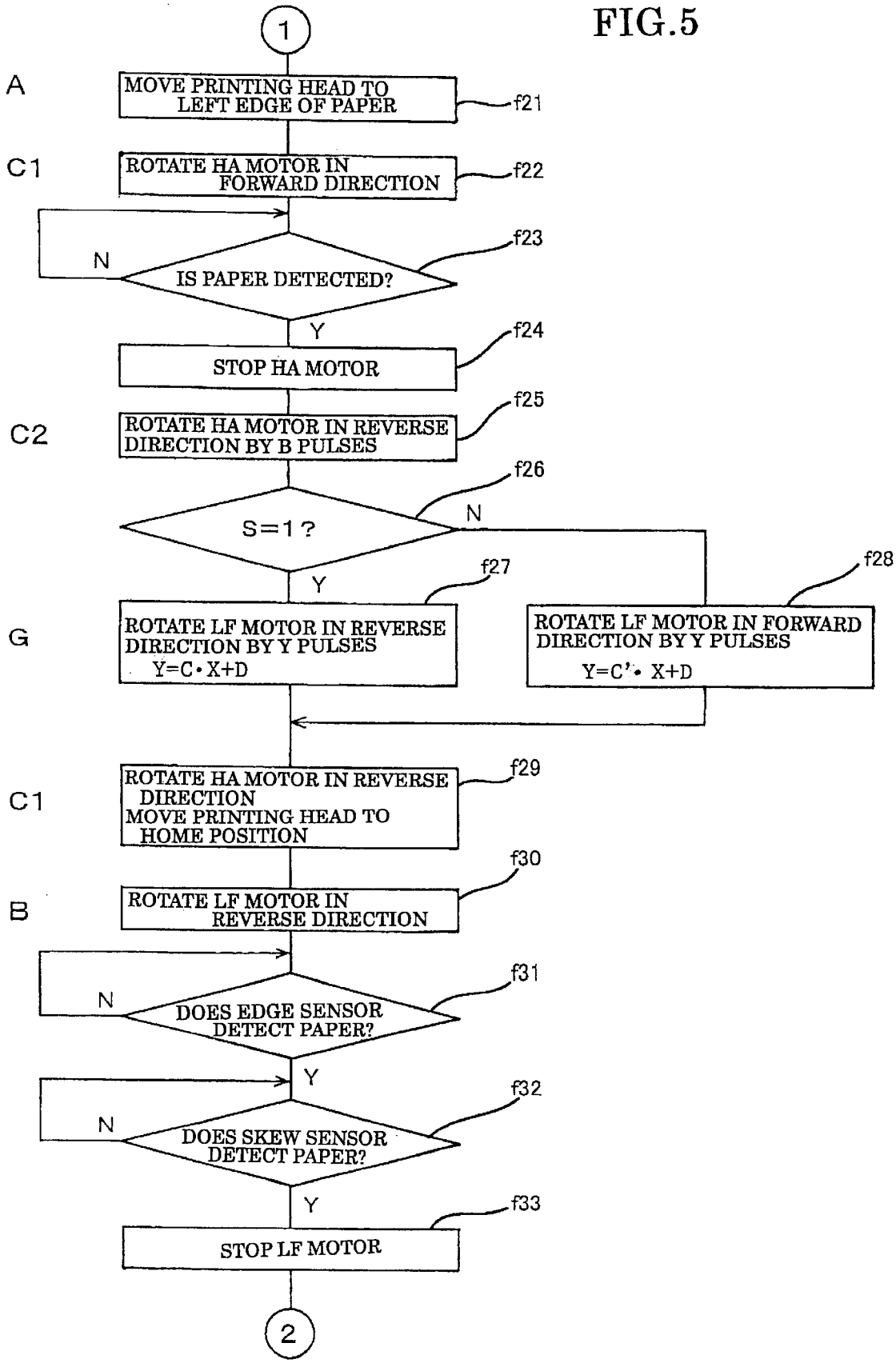
FIG. 5 is a flow chart for explaining an operation of correcting a tilted state of paper.

As shown in the flow chart in FIG. 4 and FIG. 5, a judgment is made by the paper sensor 53 as to whether a cut form of paper has been inserted into the printer or not (f1). The judging operation is repeated while no paper is detected by the paper sensor 53 and, when paper is detected, the paper feed means B sets 0 in an LF counter of the paper feed motor 21 and rotates the paper feed motor 21 in the forward direction (f2). When paper is fed by the paper feed motor 21; it is judged whether the paper has reached the position of the edge sensor 51 (f3); it is judged whether paper has been detected by the skew sensor 52 when no paper is detected by the edge sensor 51 (f4); and the judgments are continued until paper is detected by either of the paper detecting sensors E. When it is judged that the edge sensor 51 has first detected paper (f3), the value in the LF counter of the paper feed motor 21 at that time is set in an edge counter of the edge sensor 51 (f5). The forward rotation of the paper feed motor 21 continues, and it is judged whether the paper has reached the position of the skew sensor 52 (f6). When paper is detected by the skew sensor 52, the value in the LF counter of the paper feed motor 21 at that time is set in a skew counter of the skew sensor 52; and S is set at "0" (f7). Then, the value in the edge counter of the edge sensor 51 is subtracted from the value in the skew counter of the skew sensor 52 to calculate a value X (f8). The value X is then compared with a maximum value A of allowable skew in a predetermined range (f9). When the value X is smaller than the predetermined range A (X<A), the process of locating the head of paper is terminated (f10), and the process then enters a normal printing operation.

The above-described state of the paper can be summarized as follows. Since the paper was inserted upward from a lower part in FIG. 3 and first detected by the edge sensor 51, the paper was inserted with the left edge thereof in the lead. The value X indicates the state of a delay of the subsequent detection of the paper with the skew sensor 52, i.e., the amount of a tilt of the paper. That is, when S=0, it indicates the direction of a tilt at which the paper is inserted such that the left edge thereof leads. Further, the relationship expressed by X<A indicates that the amount of the tilt of the paper is in a predetermined range and that it is an allowable amount of tilt, and it is therefore judged that a printing operation can be performed in a normal manner in the same state.

Further, when the paper is detected by the skew sensor 52 before it is detected by the edge sensor 51 (f4), the value in the LF counter of the paper feed motor 21 at that time is set in the skew counter of the skew sensor 52 (f11). The forward rotation of the paper feed motor 21 continues, and it is judged whether the paper has reached the position of the edge sensor 51 (f12). When the paper is detected by the edge sensor 51, the value in the LF counter of the paper feed motor 21 at that time is set in the counter of the edge sensor 51; and S is set at "1" (f13). Then, the value in the skew counter of the skew sensor 52 is subtracted from the value in the edge counter of the edge sensor 51 to calculate the value X (f14). The value X is then compared with the maximum value A of allowable skew (f9). When the value X is smaller than the maximum value A of allowable skew (X<A), the process of locating the head of paper is terminated (f10), and the process then enters a normal printing operation.

The above-described state of the paper can be summarized as follows. Since the paper was first detected by the skew sensor 52, the paper was inserted with the right edge thereof in the lead. The value X indicates the state of a delay of the subsequent detection of the paper with the edge sensor 51, i.e., the amount of a tilt of the paper. That is, when S=1, it indicates the direction of a tilt at which the paper is inserted such that the right edge thereof leads. Further, the relationship expressed by X<A indicates that the amount of the tilt of the paper is in the predetermined range and that it is an allowable amount of tilt, and it is therefore judged that a printing operation can be performed in a normal manner in the same state.

While the process directly proceeded to a printing operation because X<A in the above examples, a printing operation cannot be performed in a normal manner when X>A because the amount of the tilt is greater than the predetermined range or the allowable maximum value A. In this case, it is therefore necessary to correct the skew of the paper.

The skew correcting means G will be described with reference to the flow chart in FIG. 5. In this example, the sandwiched portion is always one edge of paper in the direction of the width thereof regardless of the direction of a tilt of the paper, and the feeding direction of the paper is switched depending on the direction of the tilt. Then, the printing head 41 is first moved to the position of the left edge of the paper with the head driving means A (f21). Specifically, the carriage motor 11 is driven to move the printing head 41 to the left edge; the gap adjusting motor 31 is driven for forward rotation (f22); the printing head 41 is lowered by the moving mechanism C1; and it is judged whether the printing head 41 has detected the paper (f23). When the printing head 41 is lowered into contact with the paper with a predetermined pressure, an HA sensor 32 such as a micro-switch (shown in FIG. 1) generates an output, and the output signal is supplied to the gap adjusting circuit 30. The printing head 41 is thus urged against the platen 42, and it is possible to detect that the paper has been tightly sandwiched between the printing head 41 and the platen 42. The gap adjusting motor 31 is then stopped (f24). Next, the gap adjusting means C2 rotates the gap adjusting motor 31 in the reverse direction for B pulses with that position used as a reference (f25). The printing head 41 is elevated by reversing the gap adjusting motor 31, and the B pulses set here are a number of pulses that cause the printing head 41 to be elevated very slightly. Specifically, the printing head 41 is very slightly elevated from the state in which the printing head 41 has been lowered to tightly sandwich the paper between the platen 42 and itself to sandwich the paper more gently with a slight gap such that it can be rotated in the sandwiched state. The B pulses are a learned value and are a value that is preset by repeating a test. As a result of the operations up to this point, the paper is rotatably sandwiched by the printing head 41 and the platen 42 at the left edge thereof.

Next, it is judged which of S=1 and S=0 is true before the skew correcting means G is entered (f26). Since the state expressed by S=1 is a state in which paper is inserted in a direction that is tilted such that the right edge thereof leads as described above, the paper feed motor 21 is rotated in the reverse direction for Y pulses (f27). Y=C·Y+D is true, and the paper is retracted as a result of the reverse rotation of the paper feed motor 21. Since the left edge of the paper is gently sandwiched, the paper is rotated clockwise about the left edge thereof, which causes the right edge to be retracted to mitigate the tilted state. The value C and the value D are learned values and are preset by repeating a test. Since the state expressed by S=0 is a state in which paper is inserted in a direction that is tilted such that the left edge thereof leads as described above, the paper feed motor 21 is rotated in the forward direction for Y pulses (f28). Y=C·Y+D' is true, and the paper is advanced as a result of the forward rotation of the paper feed motor 21.

Since the left edge of the paper is gently sandwiched, the paper is rotated counterclockwise about the left edge thereof, which causes the right edge to be advanced to mitigate the tilted state. The value C' and the value D' are learned values and are preset by repeating a test. Since this operation temporarily corrects the tilted state, the gap adjusting motor 31 is rotated in the reverse direction to move the printing head 41 upward with the moving mechanism C1, thereby returning the same to a home position thereof (f29).

The paper feed motor 21 is then rotated in the reverse direction by the paper feed means B (f30) to retract the paper. When the edge sensor 51 judges that there is no paper (f31) and the skew sensor 52 also judges that there is no paper (f32), the paper feed motor 21 is stopped (f33). The process then returns to the flow in FIG. 4 again to check the state of tilting of the paper through the same operations. When it is judged that X<A (f9), the process of locating the head of the paper is terminated, and printing is then performed on the paper according to a normal procedure.

Figure 6:
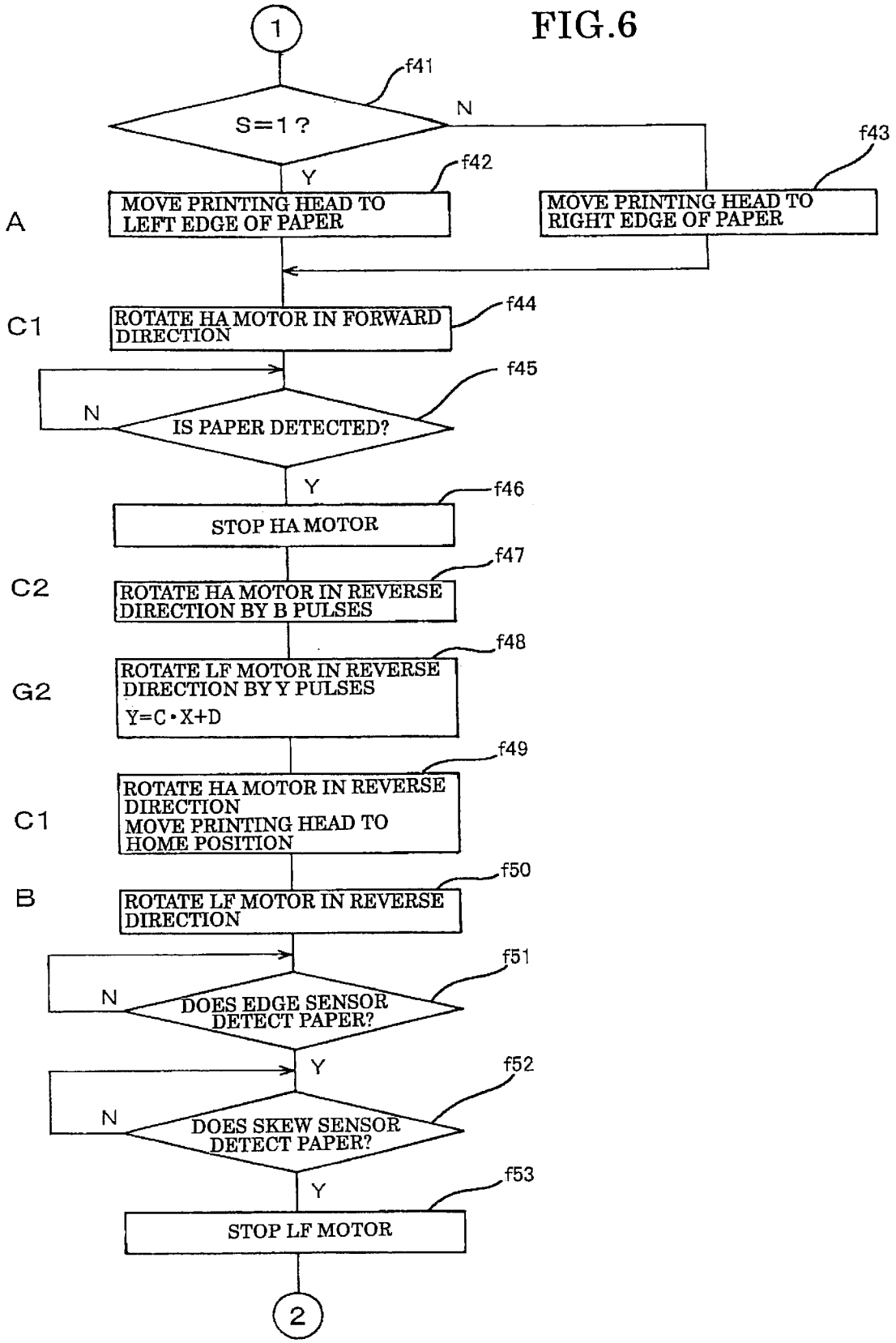
FIG. 6 is a flow chart for explaining another operation of correcting a tilted state of paper.

The skew correcting means is not limited to FIG. 5, and skew correcting means G2 as shown in the flow chart in FIG. 6 may be employed. The operation of the same will now be described. In this example, a sandwiched position of paper is changed depending on the direction in which the paper is tilted, and the paper is fed always in a constant direction regardless of the tilting direction. Specifically, it is first judged which of S=1 and S=0 is true (f41). The state expressed by S=1 is a state in which paper is inserted in a direction that is tilted such that the right edge thereof leads as described above, the head driving means A drives the carriage motor 11 to move the printing head 41 to the position of the left edge of the paper (f42). The state expressed by S=0 is a state in which paper is inserted in a direction that is tilted such that the left edge thereof leads as described above, the carriage motor 11 is driven to move the printing head 41 to the position of the right edge of the paper (f43). The moving mechanism C1 then drives the gap adjusting motor 31 for forward rotation (f44) to lower the printing head 41 close to the paper. The sensor 32 judges whether the printing head 41 has detected the paper (f45). If yes, the gap adjusting motor 31 is stopped (f46), and that position is then used as a reference. This state is a state in which the paper is tightly sandwiched between the printing head 41 and the platen 42 as described above. Next, the gap adjusting means C2 rotates the gap adjusting motor 31 in the reverse direction for B pulses (f47) to elevate the printing head 41 very slightly as described above. The paper is then put in a gently sandwiched state in which the paper can be rotated while it is sandwiched.

Next, the skew correcting means G2 rotates the paper feed motor 21 in the reverse direction for Y pulses (f48). The paper is retracted as a result of the reverse rotation of the paper feed motor 21 as described above. However, since the left edge or right edge of the paper is gently sandwiched, the paper is rotated clockwise or counterclockwise about the left edge or right edge thereof, which retracts the right edge or left edge to mitigate the tilted state. Since this operation has temporarily corrected the tilted state in which the paper is inserted at an angle, the gap adjusting motor 31 is rotated in the reverse direction as described above (f49) to elevate the printing head 41 with the moving mechanism C1, thereby returning it to a home position thereof.

Next, the paper feed motor 21 is rotated in the reverse direction by the paper feed means B (f50) to retract the paper. When the edge sensor 51 judges that there is no paper (f51) and the skew sensor 52 also judges that there is no paper (f52), the paper feed motor 21 is stopped (f53). The process then returns to the flow in FIG. 4 again to check the state of tilting of the paper through the same operations. When it is judged that X<A (f9), the process of locating the head of the paper is terminated, and printing is then performed on the paper according to a normal procedure.

While the edge sensor 51 and the skew sensor 52 are disposed on the paper guide 9 in the above-described examples, the same effects can be achieved by disposing the edge sensor 51 and the skew sensor 52 on a ribbon guide 43.

As described above in detail, in a printer according to the invention, skew is corrected by sandwiching paper with a head driving mechanism for moving a printing head along a platen, a moving mechanism for moving the printing head toward and away from the platen, and gap adjusting means and by rotating the paper with paper feed means. It is therefore possible to correct a tilted state of paper with a simple configuration without a need for any special mechanism other than those of a printer and to provide an apparatus that can preferably perform printing by preventing paper from being transported in a tilted state.

DESCRIPTION OF REFERENCE NUMERALS AND SIGNS

| | |
|---|---|
| A: | head driving means |
| B: | paper feed means |
| C1: | moving mechanism |
| C2: | gap adjusting means |
| E: | paper detecting sensor |
| G, G2: | skew correcting means |
| 41: | printing head |
| 42: | platen |

What we claim is:

1. A printer comprising:

a head driving unit for moving a printing head along a platen in the direction of the width of paper that is orthogonal to a paper feed direction;

a paper feed unit for feeding paper into a gap between the printing head and the platen;

paper detecting sensors for detecting the position of the leading edge of the paper in a plurality of positions in the direction of the width of the paper when the paper is fed;

a moving mechanism for moving the printing head toward and away from the platen; and a gap adjusting unit for driving the moving mechanism in the direction in which the printing head moves toward the platen to urge the printing head against the paper and for spacing the printing head from the platen a predetermined amount with the position serving as a reference, thereby adjusting the gap between the printing head and the platen; and a skew correcting unit for detecting the direction and amount of a tilt of the paper based on signals output by the paper detecting sensors when the paper is fed and for driving the head driving unit and the moving mechanism such that an edge of the paper in the direction of the width thereof is sandwiched between the printing head and the platen when the amount of the tilt exceeds a predetermined range and driving the paper feed unit such that the paper is rotated about the sandwiched portion depending on the direction of the tilt, thereby correcting the amount of the tilt such that it stays in the predetermined range.

2. A printer according to claim 1, wherein the skew correcting unit controls the driving of the head driving unit and the paper feed unit such that the sandwiched portion is always the edge of the paper in the direction of the width thereof regardless of the direction of tilt and such that the feeding direction of the paper is switched depending on the direction of the tilt.

3. A printer according to claim 1, wherein the skew correcting unit switches the sandwiched portion between the edge of the paper in the direction of the width thereof and another edge of the same depending on the direction of the tilt and controls the driving of the head driving unit and the paper feed unit such that the feeding direction of the paper is always a constant direction regardless of the direction of the tilt.

4. A printer according to claim 1, wherein the paper detecting sensor is disposed in a position in which it faces both edges of the paper in the direction of the width thereof.

* * * * *